US007677791B2

(12) United States Patent
Firey

(10) Patent No.: US 7,677,791 B2
(45) Date of Patent: Mar. 16, 2010

(54) ROTARY RESIDUAL FUEL SLURRIFIER

(76) Inventor: Joseph Carl Firey, P.O. Box 15514, Seattle, WA (US) 98115-0514

( * ) Notice: Subject to any disclaimer, the term of this patent is extended or adjusted under 35 U.S.C. 154(b) by 560 days.

(21) Appl. No.: 11/796,714

(22) Filed: Apr. 30, 2007

(65) Prior Publication Data

US 2008/0172934 A1 Jul. 24, 2008

Related U.S. Application Data

(60) Provisional application No. 60/881,860, filed on Jan. 23, 2007.

(51) Int. Cl.
*B01F 9/10* (2006.01)

(52) U.S. Cl. ..... 366/175.3; 366/178.1; 366/180.1

(58) Field of Classification Search ..... 366/175.3, 366/178.1, 180.1
See application file for complete search history.

(56) References Cited

U.S. PATENT DOCUMENTS 2,010,405 A * 8/1935 MacIssac ..... 366/173.1
2,392,542 A * 1/1946 Matuszak ..... 366/169.2
2,667,338 A * 1/1954 Hemfort ..... 366/173.1
2002/0046086 A1 * 4/2002 Pletz et al. ..... 705/14
2005/0226094 A1 * 10/2005 Damhuis ..... 366/175.3

* cited by examiner

*Primary Examiner*—David L Sorkin

(57) ABSTRACT

A rotary slurrifier of this invention comprises a pair of spinning discs, which throw a first fluid into a larger mass of second fluid in paired and flow connected impact cavities, within a counter-rotating cavity shell. The first fluid is to be largely insoluble in the second fluid. Impact of the first fluid with the larger mass of second fluid, in the impact cavities, causes atomization of the first fluid into a slurry of many small first fluid particles suspended in a continuous phase of second fluid. The final slurry flows out of the rotating cavity shell via a slowdown reaction turbine.

High viscosity residual petroleum fuels and tars as first fluids can be thusly preatomized in a fuel in water slurry, and can then be cleanly and efficiently burned in small bore, high speed, diesel engines, which now require use of expensive low viscosity distillate fuels, which are in short supply.

15 Claims, 10 Drawing Sheets

LIQUID SURFACE GEOMETRY IN A ROTATING PAIR OF IMPACT CAVITIES

SECTION A-A OF FIG. 2

FIGURE 5
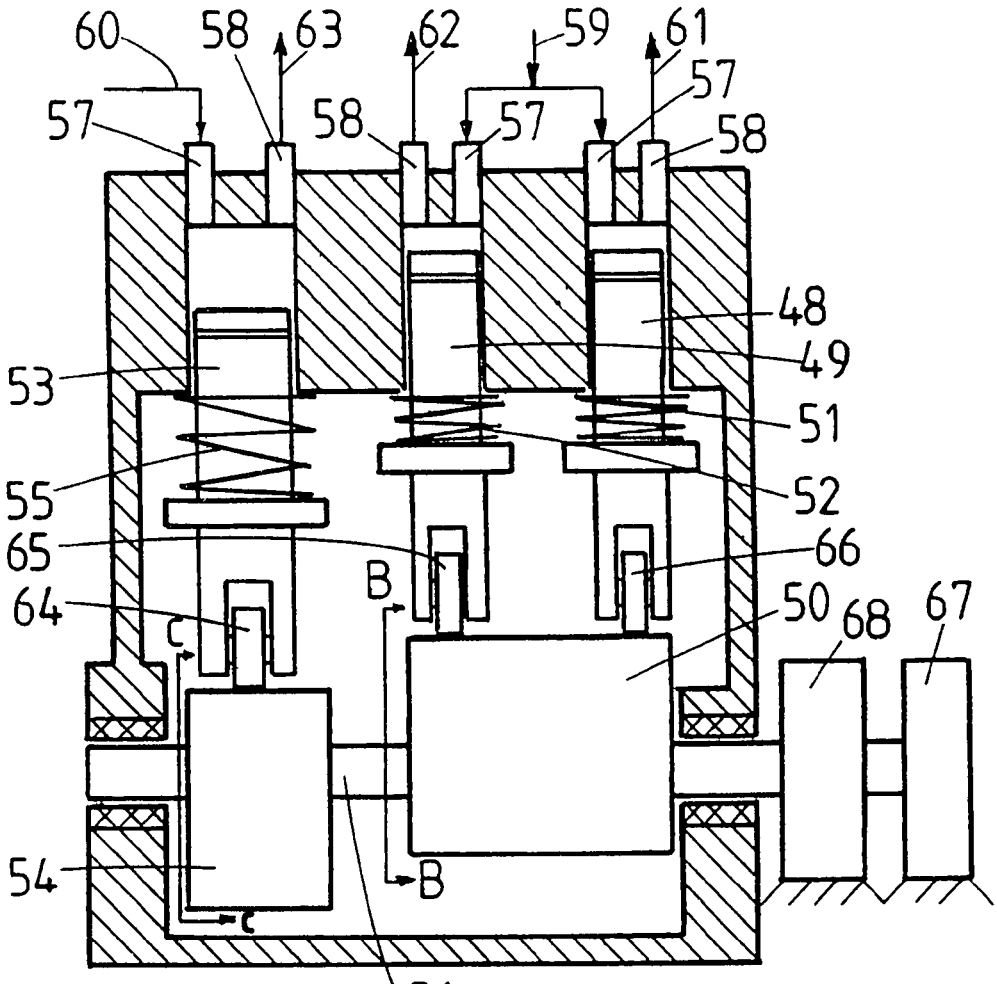
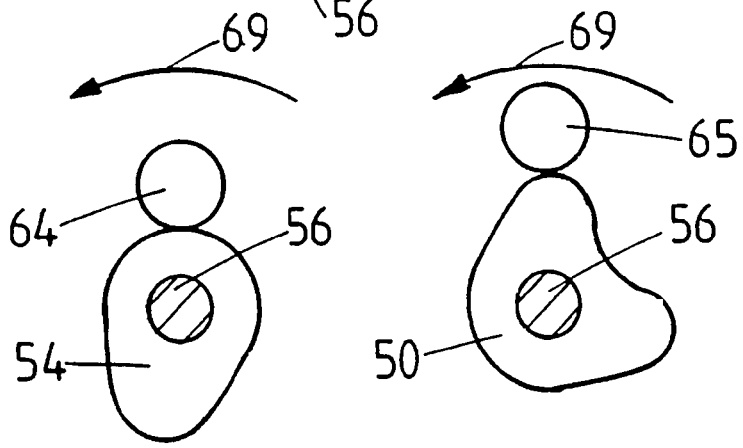
SECTION C-C OF FIG, 5
SECTION B-B OF FIG, 5
FIGURE 6

SECTION D-D OF FIGURE 7

SPINNING DISC AND IMPACT CAVITY SHELL RPM FOR SLURRIFIER ATOMIZATION OF NO, 5 FUEL OIL EQUIVALENT TO DIESEL ENGINE ATOMIZATION OF NO, 2 DIESEL FUEL

ROTARY RESIDUAL FUEL SLURRIFIER

CROSS REFERENCES TO RELATED APPLICATIONS

The invention described herein is directly related to my earlier filed U.S. Provisional Patent Application Ser. No. 60/881,860, filed 23 Jan. 2007, Joseph Carl Firey inventor, entitled, "Rotary Residual Fuel Slurrifier." This material is incorporated herein by reference thereto.

The invention described herein can be used beneficially in combination with the inventions described in my following related U.S. applications:

A. "Supplementary Slurry Fuel Atomizer," Provisional U.S. Patent Application Ser. No. 60/838,950, filed 21 Aug. 2006.

B. "Common Rail Supplementary Atomizer for Piston Engines," Provisional U.S. Patent Application Ser. No. 60/855,111, filed 30 Oct. 2006.

C. "Supplementary Slurry Fuel Atomizer and Supply System," U.S. patent application Ser. No. 11/633,107, filed 4 Dec. 2006.

BACKGROUND OF THE INVENTION

Use of high viscosity, residual, petroleum fuels, in our surface transportation system, is currently limited to large bore, low speed, marine diesel engines. Other surface transportation, such as railroads, tug and barge, trucks and buses, use small or medium bore diesel engines, which now require use of low viscosity, distillate petroleum fuels, which are in short supply and expensive. New petroleum discoveries in recent years have tended toward a higher residual fuel content, the Athabaska tar sands being an example of a crude oil almost entirely composed of residual fuel. Residual fuels can be processed partially into distillate fuels, but stock, and hence energy, losses result. National energy independence could be substantially assisted if a major portion of our surface transportation system could be operated on low cost residual petroleum fuels and tars.

BRIEF DESCRIPTION OF THE DRAWINGS

The various elements of a rotary slurrifier of this invention are shown schematically in the outline drawing of FIG. 1.

An example form of the invention using a single pair of spinning discs and flow connected pair of aligned impact cavities is shown schematically in FIG. 2.

Figure 2:
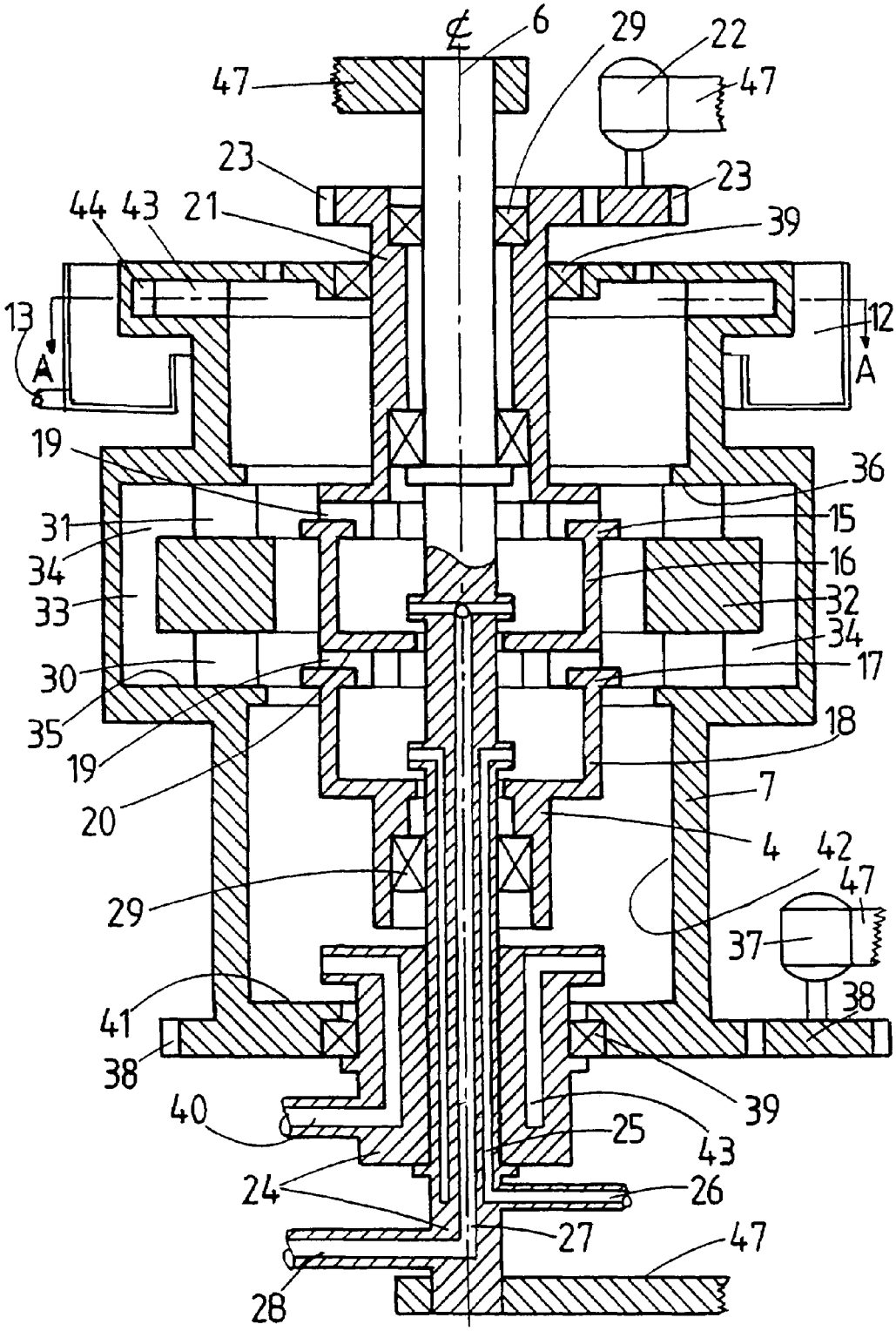
Figure 4:
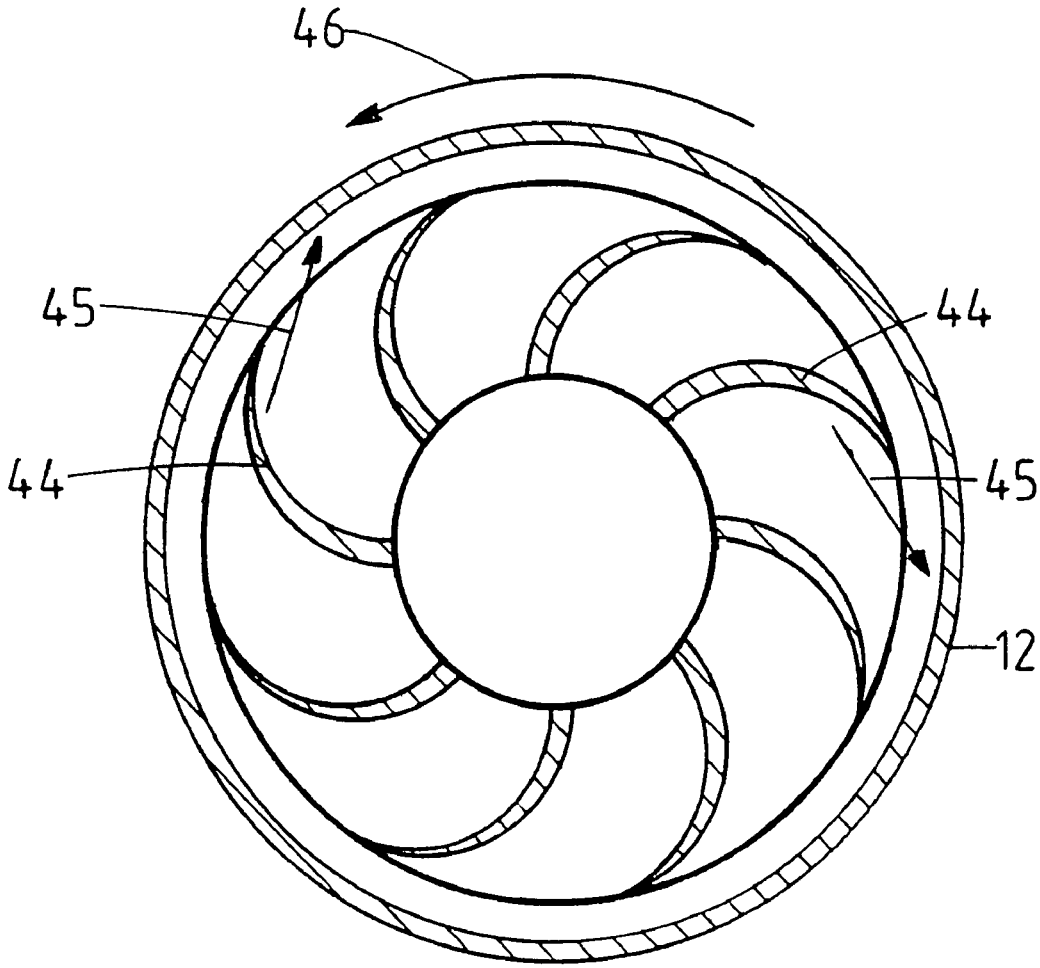

The cross section A-A of FIG. 2 is shown schematically in FIG. 4 to illustrate the slowdown reaction turbine portion of a rotary slurrifier of this invention.

An example fluid delivery apparatus for delivering first fluid and second fluid, on to the spinning discs, and into the impact cavities, is shown schematically in FIG. 5 and FIG. 6.

Figure 7:
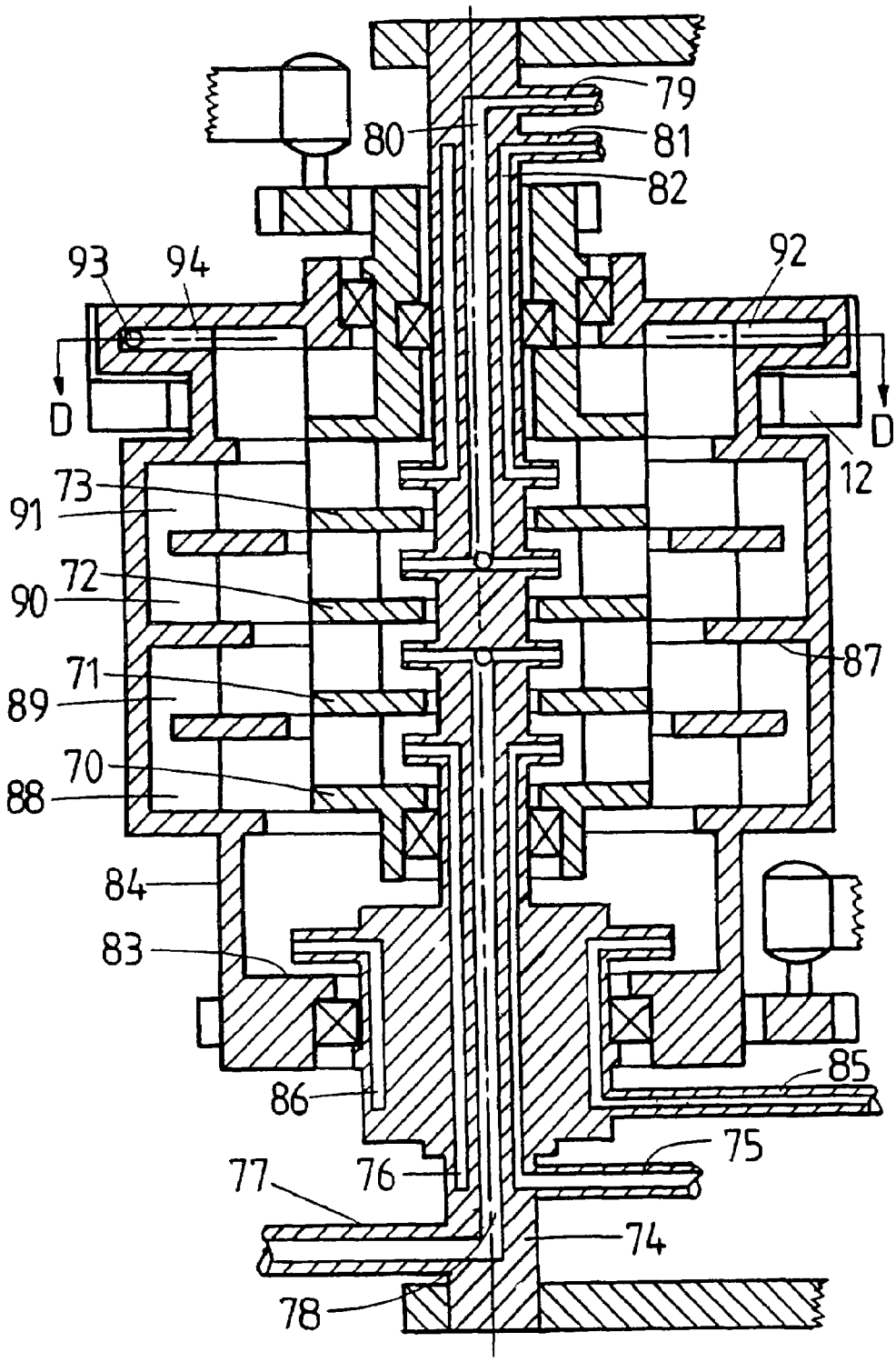

Another example form of the invention is shown in FIG. 7 using two pairs of spinning discs aligned with two pairs of flow connected, aligned, impact cavities.

Figure 8:
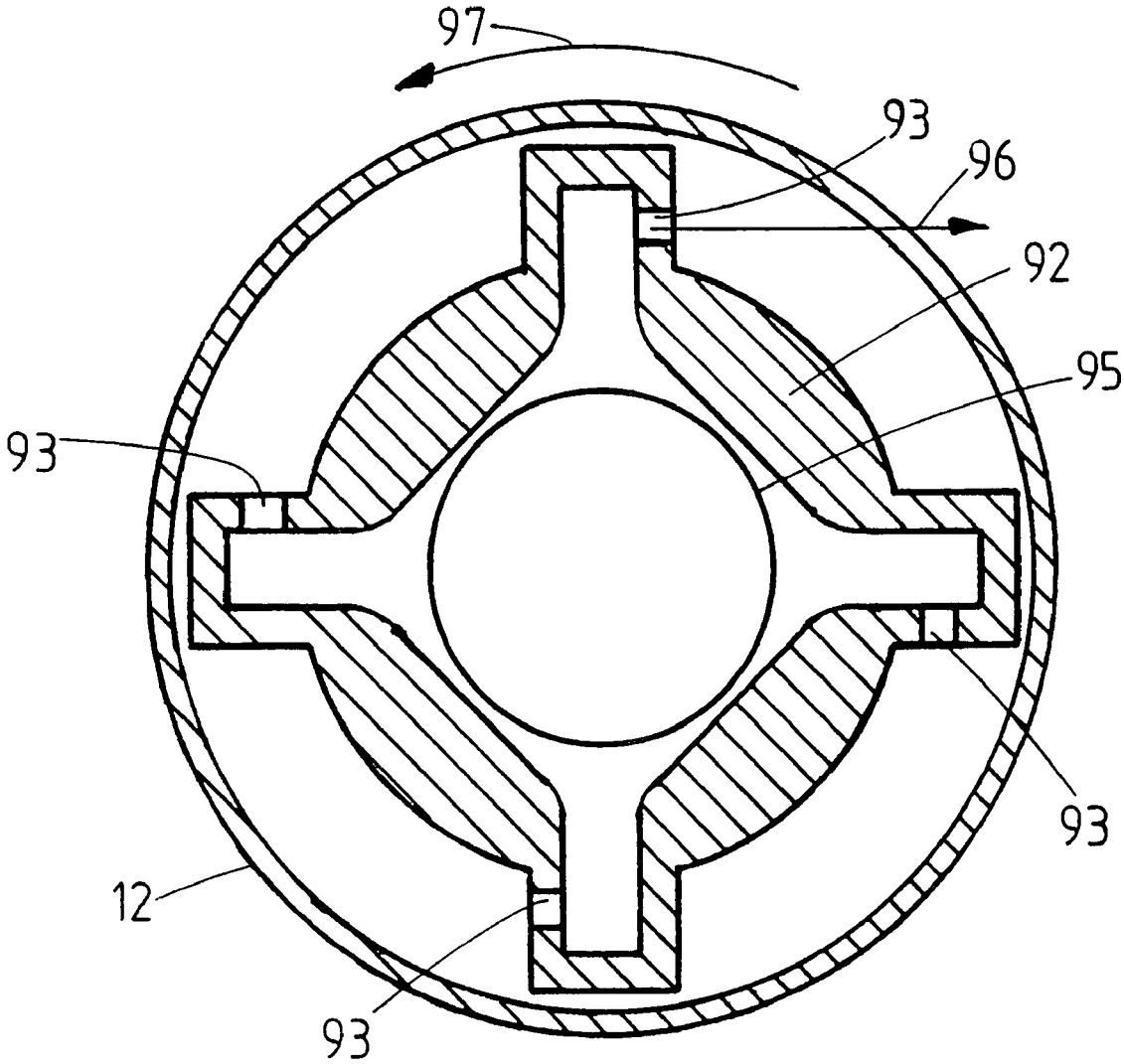

The cross section D-D of FIG. 7 is shown in FIG. 8 to illustrate another form of slowdown reaction turbine portion of a rotary slurrifier of this invention.

Figure 9:
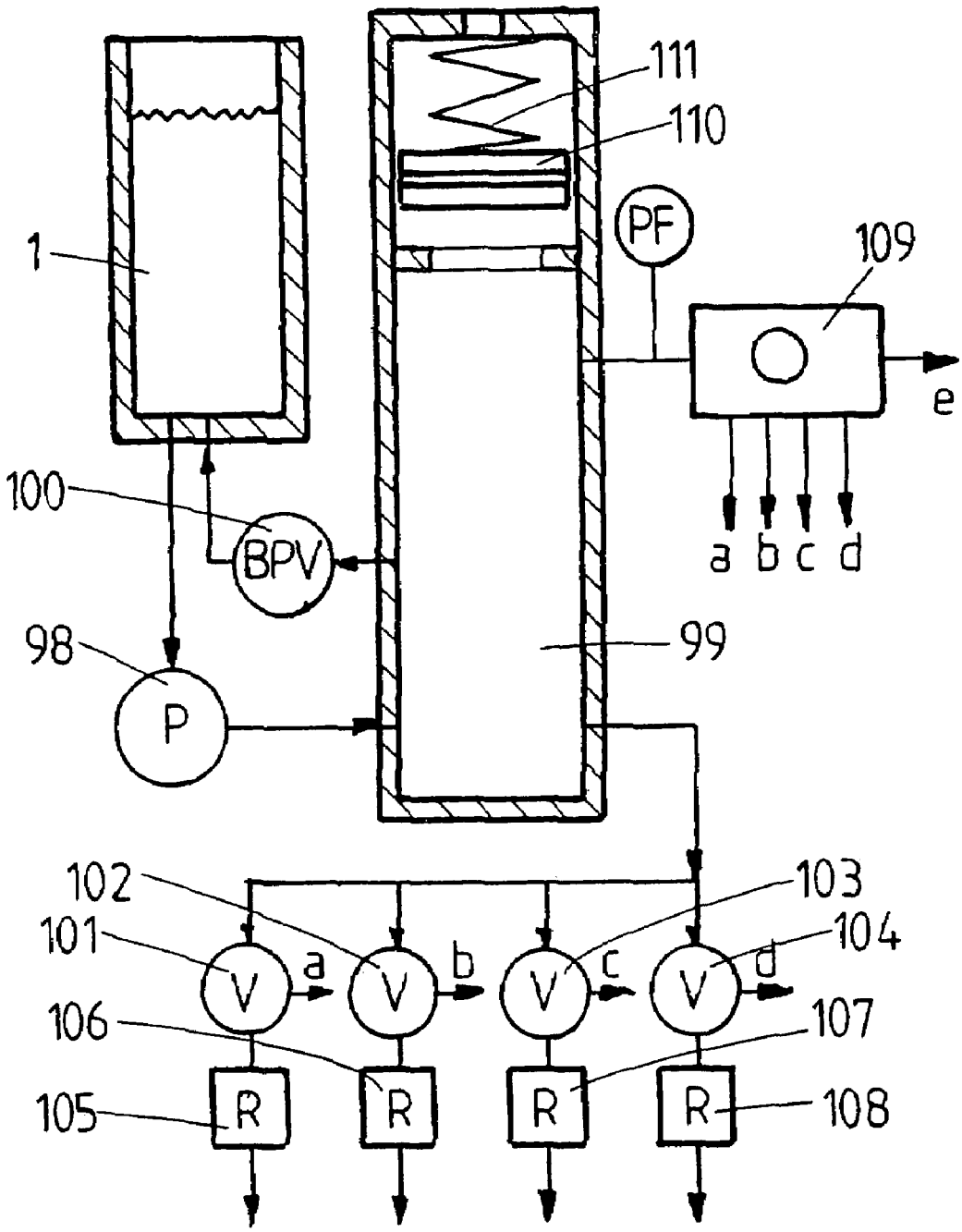

Another example fluid delivery apparatus is shown schematically in FIG. 9.

Figure 10:
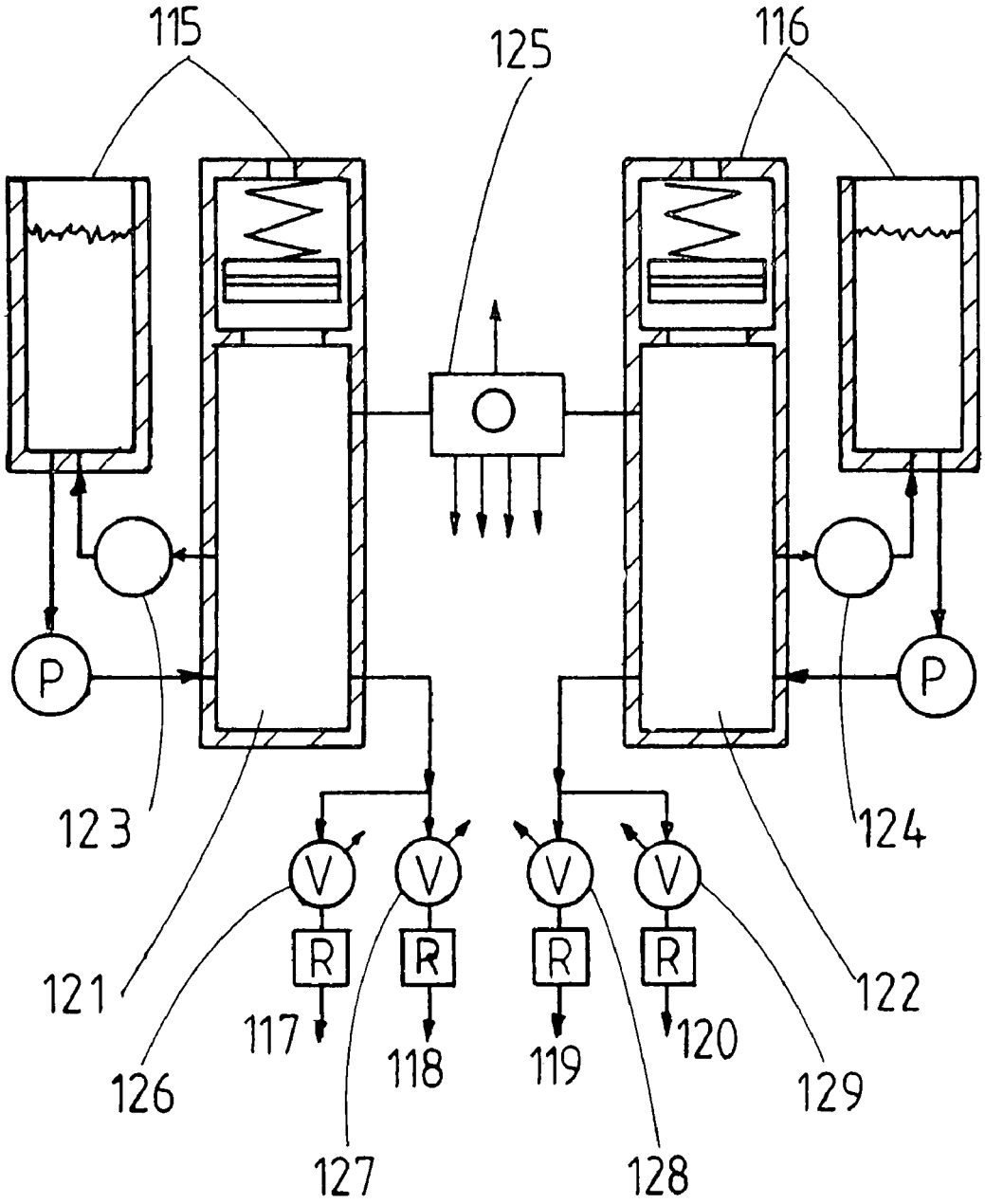

The fluid delivery apparatus shown schematically in FIG. 10 can be used to deliver two separate, and different, first fluids onto two separate pairs, or groups of pairs, of spinning discs.

Figure 11:
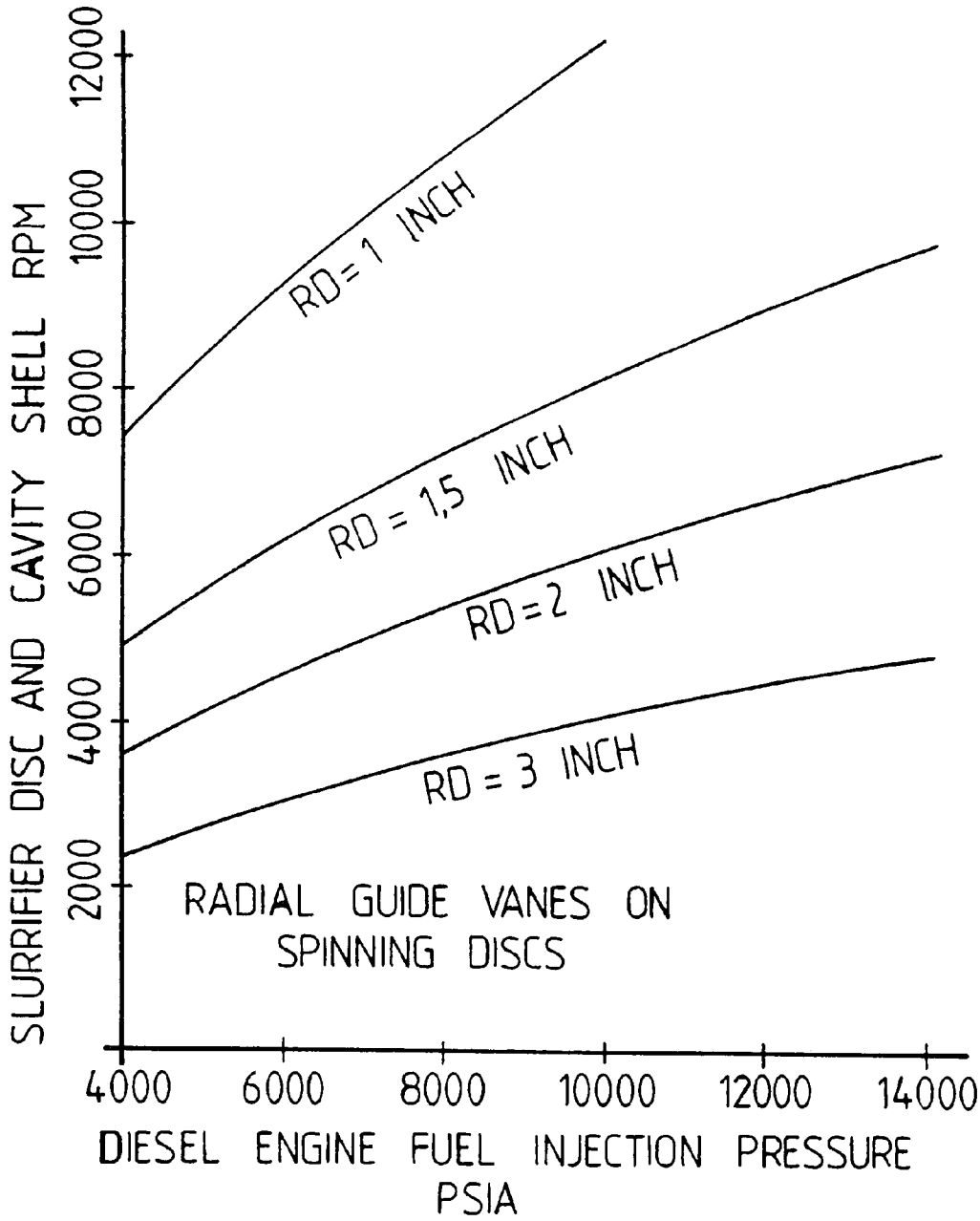

Slurrifier operating speeds required to achieve atomization of number five fuel oil in a slurrifier equivalent to atomization of number two diesel fuel in a diesel engine are shown on FIG. 11.

None of the apparatus drawings are to scale.

DESCRIPTION OF THE PREFERRED EMBODIMENTS

Rotary slurrifiers of this invention comprise at least one pair of discs, rotating at a high angular velocity as spinning discs, which apply centrifugal force to a first liquid, placed on the top surfaces of pairs of spinning discs, to accelerate the first liquid to a high velocity leaving the discs outer edge. This high velocity first liquid is thrown into counter-rotating, larger masses of second liquid within paired flow connected impact cavities, in a cavity shell counter-rotating at high angular velocity. The second liquid is essentially mutually insoluble in the first liquid. Each pair of spinning discs throws first liquid into a flow connected pair of rotating impact cavities containing the second liquid. In this way the impact forces in the paired cavities are counterbalanced.

The resulting high relative velocity between the first liquid entering into the larger mass of the second liquid in combination with the high density of a second liquid, creates strong atomizing forces. These strong atomizing forces act on the first liquid to break up even high viscosity first liquids into many small particles suspended in a continuous phase of the second liquid as a slurry.

The rotating slurry can be removed from the impact cavities, via a slowdown reaction turbine portion of the cavity shell, into a slurry collector. The first liquid can be placed on to the spinning discs, from a source, as a steady flow, with a corresponding steady flow of second liquid, from its source, into the rotating impact cavities. Alternatively, the first liquid can be placed on to the spinning discs in separate pulses, or groups of pulses, with the second liquid being placed into the impact cavities as a single pulse, between first liquid pulses or groups of pulses.

A. Outline Description of the Apparatus

Figure 1:
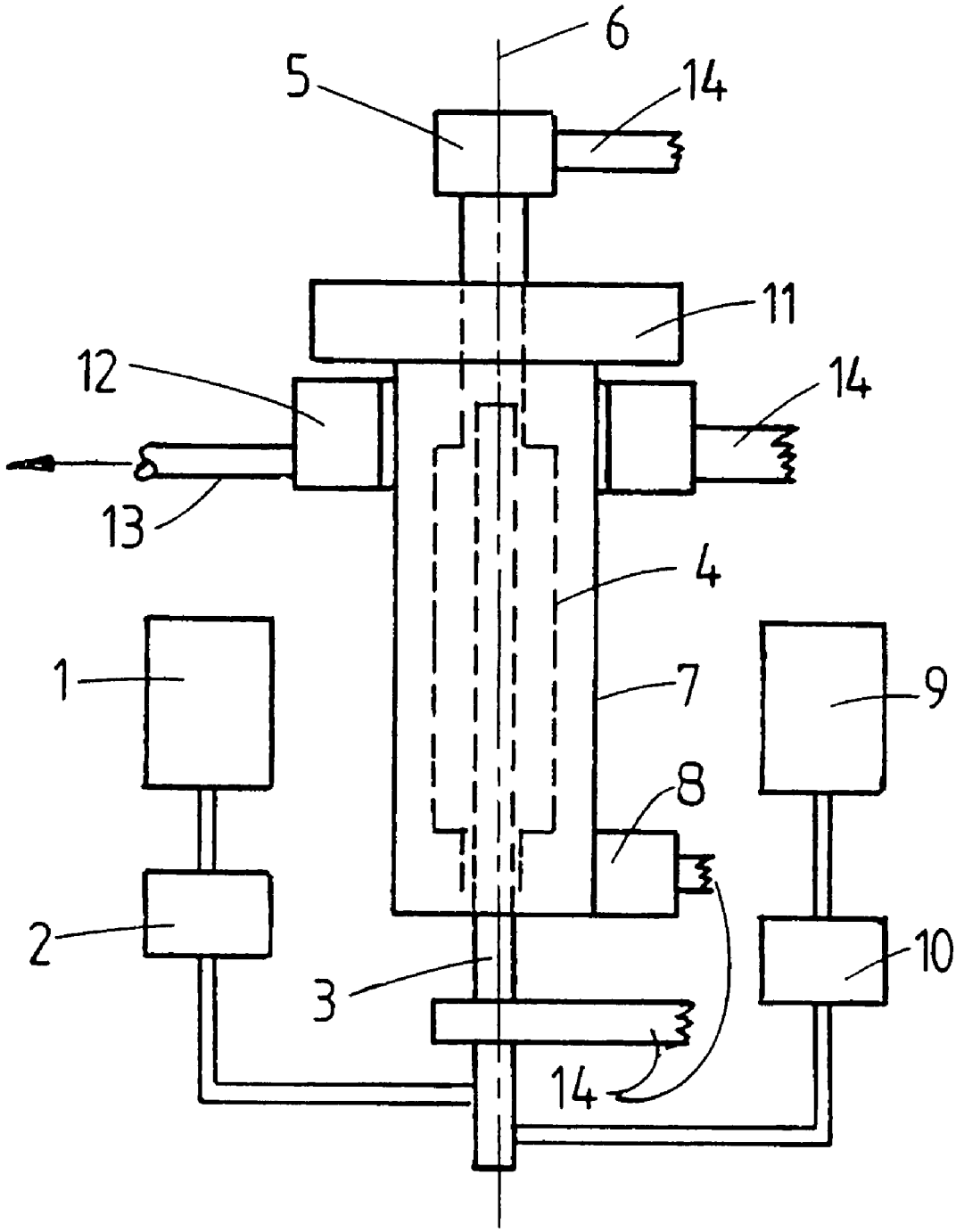

The principle components, of a rotary slurrifier of this invention are illustrated in the schematic block diagram of FIG. 1. The following nomenclature is used herein, and in the claims, for these components, as illustrated in FIG. 1, and as described in greater detail hereinafter, and in additional, more detailed Figures.

1. First fluid, from a single source of first fluid, (1), is delivered in portions, by a first fluid delivery means, 2, into a fluid delivery manifold, 3, centrally positioned inside a rotating spinning disc shell, 4, comprising at least one pair of spinning discs. These first fluid portions are delivered from the fluid delivery manifold on to the spinning discs, and eventually transfer to the top surface of each spinning disc.
2. The disc driver, 5, rotates the spinning disc shell, 4, and the spinning discs, at high angular velocity about the vertical spinning disc centerline, 6, of rotation and symmetry. Centrifugal force, due to this rotation, forces those first fluid portions, delivered on to the top surfaces of each spinning disc, to be thrown off the outer radius of each spinning disc.

3. A rotating cavity shell, 7, surrounds and encloses the rotating spinning disc shell, 4, and is rotated, at high angular velocity, by the cavity shell driver, 8, about the vertical cavity shell centerline of rotation and symmetry, which is coincident with the spinning disc centerline, 6, of rotation. Preferably the cavity shell, 7, rotates in a direction opposite to that of the spinning disc shell, 4.
4. The rotating cavity shell comprises a number of pairs of flow connected impact cavities equal to the number of pairs of spinning discs. Each flow connected impact cavity pair is aligned with a spinning disc pair, so that first fluid, thrown off the outer radius of the aligned spinning disc, enters into the impact cavity. Each flow connected impact cavity pair comprises a bottom cylindrical entry plate, and a top cylindrical exit plate whose inner radius is greater than that of the entry plate.
5. Second fluid, from a source of second fluid, 9, is delivered in portions, by a second fluid delivery means, 10, into a separate passage of the fluid delivery manifold, 3, and on to the top surface of the cylindrical entry plate, of the bottom pair of flow connected impact cavities. Second fluid thus comes to fill each impact cavity as rotating cylindrical masses of second fluid.
6. The first fluid and second fluid are largely insoluble in each other.
7. First fluid portions, thrown off the spinning discs into these counter-rotating cylindrical masses of second fluid, experience strong atomizing forces, due to impact, and become broken up into many small, preatomized particles of first fluid, suspended as a slurry in a continuous phase of second fluid.
8. The slurry thus created rises through the rotating pairs of flow connected impact cavities in succession, provided the inner radius of the entry plate of each impact cavity pair above is no less than the inner radius of the exit plate of the impact cavity pair below.
9. The final slurry rises out of the upper pair of impact cavities, and enters the slowdown reaction turbine, 11, portion of the rotating cavity shell, 7. The exit guide vanes of the reaction turbine direct the slurry exit flow in a direction opposite to that of the rotation of the cavity shell. The thusly slowed down final slurry is delivered into a stationary slurry collector pan, 12, and from there to usage via pan outlet, 13.
10. A stationary bracket, 14, supports the apparatus, only portions of which are shown on FIG. 1.

Various types of motors can be used for the disc driver, 5, and the cavity shell driver, 8, such as electric motors or compressed air motors. For use on diesel engines, the engine can be the driver, with a variable speed drive to maintain high angular velocities for the spinning discs, and impact cavities, over the full range of engine operating speeds.

The foregoing is a general description of the apparatus of this invention, and how it operates to create a slurry of finely atomized particles of at least one first fluid, suspended in a continuous phase of mutually insoluble second fluid. More detailed descriptions of the apparatus and its operation follow.

B. The FIG. 2 Form of the Invention

The FIG. 2 form of this invention comprises a single pair of spinning discs, aligned with a single pair of flow connected impact cavities, as illustrated schematically in FIG. 2, and comprises:

1. A spinning disc shell, 4, comprises two spinning discs with cylindrical cups, an upper spinning disc, 15, with cup, 16, and a lower spinning disc, 17, with cup, 18. Each spinning disc can be fitted with guide vanes, 19, or other structure, to secure the lower spinning disc to the cup bottom, 20, of the upper spinning disc, and secure the upper spinning disc to the drive member, 21, of the spinning disc shell, 4. The spinning discs, 15 and 17, cap the top of the cups, 16 and 18, and preferably the inner radius of the spinning discs, 15 and 17, is less than the inner radius of the cylindrical cups, 16, and 18.
2. The disc driver, 22, rotates the spinning disc shell, 4, via gears, 23, and the drive member, 21, at high angular velocity about the vertical spinning disc centerline, 6, of rotation and symmetry.
3. The stationary fluid delivery manifold, 24, is centrally positioned along the spinning disc centerline, 6, and inside the spinning disc shell, 4. The fluid delivery manifold is fitted with first fluid delivery passage, 25, which delivers first fluid from the connection, 26, onto the bottom plate of the lower spinning disc cup, 18. The fluid delivery manifold is also fitted with first fluid delivery passage, 27, which delivers first fluid from the connection, 28, onto the bottom plate of the upper spinning disc cup, 16.
4. First fluid portions are delivered to the fluid delivery manifold connections, 26 and 28, from a source, by a first fluid delivery means, to be described hereinbelow.
5. The spinning disc shell, 4, can be aligned on a symmetrical fluid delivery manifold, 24, as by bearings, 29.
6. First fluid portions, delivered on to the top of bottom plates of the spinning disc cups, 16, and 18, will be forced, by the centrifugal forces created by spinning disc and cup rotation, to form two, essentially cylindrical, masses of first fluid inside the cups, 16, and 18. The inner radius of these rotating cylindrical fluid masses will increase slightly upward, this increase being smaller at higher spinning disc angular velocity.
7. With continued delivery of portions of first fluid, on to the bottom plates of the spinning disc cups, 16 and 18, the inner radius of the two rotating cylindrical masses of first fluid, decreases, until it becomes less than the inner radius of the spinning discs, 15 and 17, which bound the top of the cups, 16 and 18. Thereafter, further delivery of first fluid causes a flow of first fluid, upward, past the inner radius of the spinning discs, 15 and 17, and on to the top surface of these discs, where centrifugal force now causes first fluid to be thrown off the outer radius of the spinning discs, and into the aligned impact cavities.
8. Centrifugal force, acting on the cylindrical masses of first fluid inside the cups, acts to angularly equalize the inner radius of these fluid masses. Hence any angular variation in the delivery of first fluid, on to the bottom plates of these cups, will be largely eliminated when the fluid passes the inner radius of the spinning discs. In this way the spinning disc cups, 16 and 18, function to create an angularly uniform mass of first fluid, being delivered onto the spinning discs top surfaces, even when first fluid portions are delivered as separate pulses on to the bottom plates of the cups. The greater the cup depth, between the top of the bottom plate of the cup and the bottom of the spinning disc, the more nearly angularly uniform will be the flow of first fluid onto the spinning discs.
9. The rotating cavity shell, 7, surrounds the spinning disc shell, 4, and comprises a single pair of flow connected impact cavities; a lower impact cavity, 30, and an upper impact cavity, 31, separated by a cylindrical separator block, 32, and flow connected together by the flow passage, 33, at their outer radius. Radial guide vanes, 34, secure the separator block, 32, to the cylindrical entry plate, 35, at the bottom of the lower cavity, 30, and the cylindrical exit plate, 36, at the top of the upper cavity, 31. These radial guide vanes also function to maintain the angular velocity of second fluid within the cavities more nearly equal to cavity shell angular velocity.

10. The cavity shell, 7, is rotated, at high angular velocity, by the cavity shell driver, 37, and gears, 38, about the cavity shell vertical centerline of rotation and symmetry, which is coincident with the spinning disc centerline of rotation, 6.

11. The inner radius of the cylindrical separator block, 32, is less than the inner radius of the cylindrical entry plate, 35, which is less than the inner radius of the Cylindrical exit plate, 36, as described hereinbelow.

12. The cavity shell, 7, can be aligned on a symmetrical fluid delivery manifold, 24, and a symmetrical spinning disc drive member, 21, as by bearings, 39. The cavity shell is thusly aligned so that the lower impact cavity, 30, center, is aligned with the top surface of the lower spinning disc, 17, and the upper impact cavity, 31, center, is aligned with the top surface of the upper spinning disc, 15. In this way, first fluid portions thrown off the spinning discs will be thrown into the aligned impact cavities.

13. Second fluid portions are delivered to the fluid delivery manifold connection, 40, from a source, by a second fluid delivery means, to be described hereinbelow. Second fluid flows from connection, 40, on to the top of the bottom plate, 41, of the cavity shell, via passage, 43.

14. Second fluid portions, delivered on to the top of the bottom plate, 41, of the cavity shell, 7, will form an essentially cylindrical mass of second fluid in the second fluid delivery cavity, 42. Continued delivery of second fluid portions will cause delivery of second fluid on to the top of the entry plate, 35, of the lower impact cavity, 30, in the same manner as first fluid was delivered, from the spinning disc cups, 16 and 18, on to the top surfaces of the spinning discs, 15 and 17, as described hereinabove.

15. The rotating second fluid is held inside the flow connected impact cavities, as a rotating, approximately cylindrical, fluid mass, by centrifugal pressure, due to fluid angular acceleration, acting to prevent gravity pressure from dumping the fluid out of the cavities. Gravitational pressure causes the inner surface of the fluid cylinder to taper outward upward, the taper decreasing at increased fluid angular velocity.

16. Continued addition of second fluid portions, into a pair of flow connected impact cavities, will decrease the inner radius of the rotating fluid mass. When this fluid inner radius becomes less than the inner radius of the cavity pair exit plate, the centrifugal pressure will cause upward flow of fluid past the inner radius of the exit plate, and into the next above cavity. But, if the inner radius of the entry plate equals that of the exit plate, the centrifugal pressure will cause a reversed and downward flow of fluid, past the inner radius of the entry plate. To prevent this downward flow the inner radius of the exit plate, of each flow connected impact cavity pair, is made greater than the inner radius of the entry plate of that flow connected impact cavity pair. Also for this reason, the inner radius of the entry plate, of a next above flow connected impact cavity pair, is to be no less than the inner radius of the exit plate of the flow connected impact cavity pair below.

Figure 3:
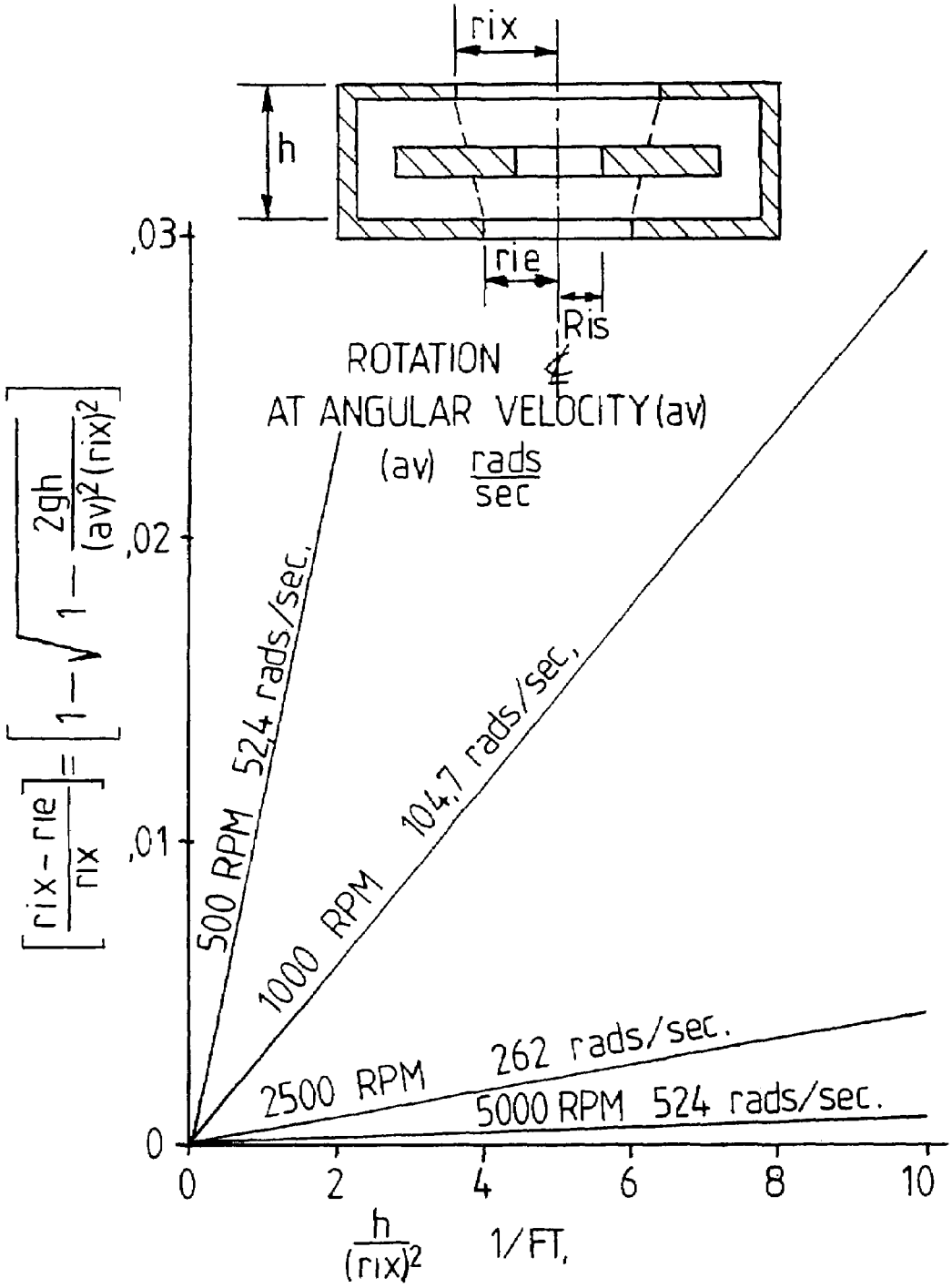
In FIG. 3 the geometric shape of a liquid surface, within a rotating pair of flow connected impact cavities is shown graphically.

17. The calculated geometry of the inner liquid surface of a mass of fluid, rotating, at steady state, in a pair of flow connected impact cavities, is shown in FIG. 3. To avoid reversed, downward, flow of fluid, past the entry plate at the bottom of the cavity pair, the actual increase of exit plate inner radius, Rix, over entry plate inner radius, Rie, must be greater than the calculated values of inner liquid surface radius increase from entry plate to exit plate:

$$\frac{Rix - Rie}{Rix} > \frac{rix - rie}{rix} = \left[1 - \sqrt{1 - \frac{2g}{(av)^2}\frac{h}{(rix)^2}}\right]$$

Wherein:

Rix=Inner radius of the exit plate of the flow connected impact cavity pair, ft.

Rie=Inner radius of the entry plate of the flow connected impact cavity pair, ft.

rix=Inner radius of the liquid surface at the exit plate, ft. For sizing purposes this can usually be set equal to Rix.

rie=Inner radius of the liquid surface at the entry plate, ft.

h=Cavity pair height, the distance between top surface of the entry plate and the top surface of the exit plate, ft.

(rix−rie)=Liquid surface steady state inner radius increase with height h, ft.

(Rix−Rie)=Cavity plates inner radius increase with height h, ft.

g=Gravitational acceleration, 32.2 ft/sec$^2$.

(av)=Angular velocity of the rotating fluid mass, radians per sec.

Any consistent system of units can be used.

18. Radial guide vanes, 34, within the impact cavities, can be used to maintain fluid angular velocity, (av), more nearly equal to cavity shell angular velocity (av). The impact of first fluid portions, thrown into the rotating fluid mass in the impact cavities, acts to reduce the fluid angular velocity, of those fluid portions impacted, below that of the cavity shell. Hence, a greater cavity plates inner radius increase (Rix−Rie), is needed as the ratio of first fluid mass flow rate into the impact cavity, to cavity fluid mass rotation rate inside the impact cavity, is increased.

19. Thus to assure the needed upward flow of second fluid, through each pair of flow connected impact cavities, and into the slowdown reaction turbine cavity, the following conditions need to be met:

(a) For each pair of flow connected impact cavities, the inner radius of the exit plate (Rix), is greater than the inner radius of the entry plate, (Rie);

(b) For each pair of flow connected impact cavities above, the inner radius of the entry plate is no less than the inner radius of the exit plate of that pair of flow connected impact cavities next below;

(c) For the slowdown reaction turbine cavity, the inner radius of the entry plate is no less than the inner radius of the exit plate of the topmost pair of flow connected impact cavities;

(d) For each pair of flow connected impact cavities the inner radius of the separator block (Ris) is less than the inner radius of the entry plate (Rie);

(e) The inner radius of the radial guide vanes, 34, within the flow connected impact cavities, 30, and 31, is greater than the inner radius of the cylindrical exit plate, 36, in order to avoid first fluid impact upon these guide vanes.

20. In general, the greater the cavity plates inner radius increase, (Rix−Rie), over the liquid surface steady state inner radius increase (rix−rie), the greater becomes the capacity of a slurrifier of this invention in the following respects:
    (a) A greater flow rate of second fluid into and through the flow connected impact cavity pairs can be used;
    (b) A greater flow rate of first fluid into the flow connected impact cavity pairs can be used;
    (c) A wider range of usable cavity shell angular velocities can be used;
    On the other hand the resulting increase of the air gap, between the spinning disc outer exit radius, and the fluid surface in the impact cavities, may somewhat reduce the average fineness of atomization achieved. The first fluid is somewhat slowed down, while crossing this low density air gap, and a lesser impact with the high density second fluid, in the impact cavities, results as an air gap increases. It is this impact between first and second fluid which accomplishes the breakup of the first fluid into many small particles, suspended in a continuous phase of second fluid, which becomes the product slurry, leaving the exit plate of the top upper impact cavity, and flowing into the slowdown reaction turbine. First fluid atomization can be improved by increasing the magnitude of the impact between first and second fluid, as by increasing the angular velocity of the disc shell, and by increasing the opposite angular velocity of the cavity shell, and by increasing the spinning disc outer radius.
21. The radial impact of first fluid, upon the second fluid, in the lower impact cavity of a pair, is balanced by the concurrent radial impact of first fluid, upon the second fluid in the upper, and flow connected, impact cavity of the pair. Thusly balanced, the second fluid remains within the paired flow connected impact cavities, while subject to essentially equal radial impacts into each cavity of the pair.
22. The final slurry product flows upward past the exit plate, 36, of the upper impact cavity, 31, and into the slowdown reaction turbine cavity, 43. The slurry leaves the reaction turbine cavity, 43, via reaction turbine guide vanes, 44, which direct the slurry out of the rotating cavity shell, 7, and into the stationary collector pan, 12, from which the slurry flows to users via collector pan outlet, 13.
23. The several reaction turbine guide vanes, 44, direct the exit flow of slurry out of the reaction turbine cavity, 43, in a direction, 45, opposite to the direction, 46, of rotation of the cavity shell and guide vanes, 44, as illustrated schematically in FIG. 4, which is a cross section view, A-A, of the reaction turbine cavity, 43. The slurry velocity relative to the stationary collector pan, 12, is the difference between guide vane, 44, velocity in direction, 46, and slurry velocity in the opposite direction, 45, as created by centrifugal pressure acting to move the slurry outward in the turbine cavity, 43, and is thus slow as desired for slurry entry into the stationary collector pan, 12.
24. The various stationary elements of the form of this invention shown in FIG. 2 are supported by a bracket, 47, only portions of which are shown in FIG. 2.
25. The centrally positioned delivery manifold, 24, is stationary, as shown schematically in FIG. 2. But a rotating central delivery manifold could be used, and secured to the rotating spinning disc shell. First fluid and second fluid could be delivered into this rotating delivery manifold via stationary sleeves, with rubbing seals on the manifold.
26. First fluid can be delivered, by the first fluid delivery means, 2, from a source, 1, onto the top of the spinning discs, 15 and 17, as a steady flow, or as a pulsed flow, of first fluid. Correspondingly second fluid can be delivered, by the second fluid delivery means, 10, from a source, 9, onto the top of the bottom entry plate, 35, of the lower impact cavity, as a steady flow, or as a pulsed flow, of second fluid. With steady flow of both fluids, that portion of the second fluid, impacted by first fluid, will always have a somewhat lower angular velocity than the cavity shell, and a consequently reduced impact, with poorer resulting atomization of first fluid. With pulsed flow of both fluids, that portion of second fluid, impacted by first fluid, can recover all, or a portion, of the angular velocity lost on impact, between pulses, and the consequently stronger impact will yield improved atomization of first fluid.
27. An example form of pulsed flow delivery system, for both first fluid and second fluid, is shown schematically in cross section in FIG. 5, and is suitable for use with the FIG. 2 form of the invention, and comprises:
    (a) Two positive displacement first fluid delivery pumps, 48 and 49, are reciprocated concurrently by the first fluid cam, 50, and suction return springs, 51 and 52.
    (b) One positive displacement second fluid delivery pump, 53, is reciprocated by the second fluid cam, 54, and suction return spring, 55.
    (c) The first fluid cam, 50, and the second fluid cam, 54, are integral with their common drive shaft, 56.
    (d) Each positive displacement pump is fitted with a suction valve, 57, and a delivery check valve, 58, in the pump cylinder head.
    (e) Both suction check valves, 57, for the two first fluid pumps, are commonly connected via connector, 59, to the source of first fluid, 1.
    (f) First fluid pump, 48, delivery check valve, 58, is connected via connector, 61, to connector, 26, on FIG. 2, and thus reciprocation of first fluid pump, 48, delivers first fluid, from source, on to the top of the lower spinning disc, 17, of FIG. 2, via the cup, 18, in pulses.
    (g) First fluid pump, 49, delivery check valve, 58, is connected via connector, 62, to connector 28, on FIG. 2, and thus reciprocation of first fluid pump, 49, delivers first fluid, from source, on to the top of the upper spinning disc, 15, of FIG. 2, via cup, 16, in pulses.
    (h) The suction check valve, 57, for the second fluid pump is connected via connector, 60, to the source of second fluid, 9.
    (i) Second fluid pump, 53, delivery check valve, 58, is connected via connector, 63, to connector, 40, on FIG. 2, and thus reciprocation of second fluid pump, 53, delivers second fluid, from source, on to the top of the entry plate, 35, of the lower impact cavity, 30, of FIG. 2, via the second fluid delivery cavity, 42, in pulses.
    (j) The two first fluid pumps, 48 and 49, and the one second fluid pump, 53, are thusly reciprocated by rotation of the first fluid cam, 50, and the second fluid cam, 54, whose cam profiles are shown schematically on FIG. 6. Section C-C of FIG. 5 is the second fluid cam profile which drives the rotary cam follower, 64, of the second fluid pump, 53. Section B-B of FIG. 5 is the first fluid cam profile which drives the rotary cam followers, 65 and 66, of the two first fluid pumps, 48 and 49. The first fluid cam, 50, and the second fluid cam, 54, are thusly rotated together by the common drive shaft, 56, driven by a drive motor, 67, via a variable speed drive mechanism, 68.

(k) When thusly rotated through one full turn, in the direction, 69, the cam, 50, will reciprocate the two first fluid delivery pumps, 48 and 49, concurrently, to deliver two first fluid pulses on to the top surfaces of each of the two spinning discs, 15 and 17. During this same full turn, the cam, 54, will reciprocate the one second fluid pump, 53, to deliver one second fluid pulse on to the top surface of the entry plate, 35, of the lower impact cavity, 30, following after the preceding delivery of two first fluid pulses on to the top surfaces of each of the two spinning discs, 15 and 17. Thus on each full revolution of the drive shaft, 56, and cams, 50 and 54, two first fluid pulses are delivered concurrently on to each spinning disc, 15 and 17, and subsequently a single second fluid pulse is delivered on to the entry plate of the lower impact cavity, 30, and this sequence of fluid pulses is repeated on each revolution of the shaft, 56, and cams, 50 and 54.

(l) The above fluid pulse pattern is only one example pattern, and a great variety of fuel pulse patterns can be used. In many applications each second fluid pulse can be followed by one or more first fluid pulses. The first fluid pulses are to be equal and concurrent on both spinning discs, for each pair of spinning discs aligned with a pair of flow connected impact cavities, in order to balance the concurrent first fluid impacts.

(m) Various types of drive motors, 67, can be used, such as electric drive motors, or compressed air motors. Where a slurrifier is to be used on board a diesel engine for a railroad locomotive, or marine diesel engine, the diesel engine can be the drive motor, 67. In this way slurry formation can be proportional to engine speed, and adjusted for engine torque via the variable speed drive mechanism, 68. For some slurrifier applications the variable speed drive mechanism, 68, will not be needed, as for example on a production slurrifier at a central refueling facility.

(n) Other types of positive displacement pumps can be used, such as the Bosch type pump plunger, where fluid pulse size is adjusted by rotating the plunger relative to a relief port.

C. The FIG. 7 Form of the Invention

More than one pair of flow connected impact cavities, and aligned pairs of spinning discs, can be used. The example rotary slurrifier, shown schematically in cross section in FIG. 7, has two pairs of flow connected impact cavities, and two pairs of aligned spinning discs. The elements of this form of the invention are similar in many ways to those of the FIG. 2 form of the invention, as described hereinabove, but differ therefrom in several ways, as follows:

1. The four spinning discs, 70, 71, 72, 73, do not have cups and the first fluid is delivered directly on to the top surfaces of the spinning discs from the stationary delivery manifold, 74.
2. The stationary delivery manifold, 74, directs first fluid delivery on to the spinning discs as follows:
   (a) On to spinning disc, 70, via connection, 75, and passage, 76.
   (b) On to spinning disc, 71, via connection, 77, and passage, 78.
   (c) On to spinning disc, 72, via connection, 79, and passage, 80.
   (d) On to spinning disc, 73, via connection, 81, and passage, 82.
3. The stationary delivery manifold, 74, directs second fluid delivery on to the bottom plate, 83, of the cavity shell, 84, via connection, 85, and passage, 86.
4. The inner radius of the exit plate, 87, of the lower pair of flow connected impact cavities, 88 and 89, is the same as the inner radius of the entry plate of the upper pair of flow connected cavities, 90 and 91.
5. The slowdown reaction turbine, 92, comprises symmetrical tangential flow slurry exit nozzles, 93, as guide vanes instead of curved guide vanes, as is shown schematically in FIG. 8, which is the cross section, D-D, of FIG. 7. These slurry exit nozzle guide vanes direct exit flow of slurry in the direction, 96, opposite to the cavity shell rotation direction, 97.
6. For maximum slowdown of the final exit slurry product, relative to the stationary collector pan, 12, the reaction turbine cavity, 94, is preferably filled with final slurry, almost up to the inner radius of the reaction turbine entry plate, 95, which is also the exit plate of the uppermost flow connected impact cavity pair, 90, 91. In this way centrifugal pressure of the fluid, on the slurry exit nozzles, 93, will create maximum difference between nozzle rotation velocity in direction, 97, and exit slurry velocity out of the nozzles, 93, in direction, 96. For this purpose, the flow rates of first fluid and second fluid must be steady, at a constant cavity shell angular velocity. Either flow rates can be matched to angular velocity or angular velocity can be matched to flow rates. Alternatively, for a particular constant cavity shell angular velocity, and hence constant first fluid atomizing impact, different slurry flow exit nozzle inserts of different flow area, can be matched to different flow rates of first fluid and second fluid.
7. An example first fluid delivery system, 2, suitable for use with the FIG. 7 form of the invention, is illustrated schematically in FIG. 9, and comprises:
   (a) The fluid circulating pump, 98, pumps first fluid from the source, 1, into the first fluid reservoir, 99, and fluid returns to the source, 1, via the back pressure valve, 100, when reservoir pressure, PF, is at set value.
   (b) First fluid, at pressure, PF, leaves the reservoir, 99, via the four valves, V, 101, 102, 103, 104, and flow restrictors, R, 105, 106, 107, 108, and is delivered into the delivery manifold, 74, of FIG. 7, via the connections, 75, 77, 79, 81, and from there on to the top surfaces of the spinning discs, 70, 71, 72, 73, respectively.
   (c) The valves, 101, 102, 103, 104, can be opened or closed via control connections, a, b, c, d, from first fluid controller, 109. The valves are thusly opened only when the first fluid pressure, PF, is at set value.
   (d) For steady flow of first fluid on to the spinning discs the valves, 101, 102, 103, 104, remain open at all times when the slurrifier is operating.
   (e) The steady flow rate of first fluid can be adjusted by adjusting the back pressure valve, 100, which sets the value of first fluid pressure, PF.
   (f) Alternatively, for concurrent pulsed flow of first fluid on to the spinning discs, the valves, 101, 102, 103, 104, can be simultaneously opened and closed by the controller, 109, to create the flow pulses. The sealed top piston, 110, with vented spring, 111, can operate to keep first fluid pressure more nearly constant, during first fluid pulse flow.

(g) The controller, 109, can be pneumatic, and act upon pneumatic valve actuators, or could be electronic, and act upon solenoid valve actuators. For pulsed flow, motor-driven cams can function as a control element, for the opening and closing of the valves.

8. The second fluid delivery system, 10, can be essentially the same as the above described first fluid delivery system of FIG. 9, except that; only one valve, V, and flow restrictor, R, are used; second fluid is delivered on to the bottom plate, 83, of the cavity shell, 84, via connection, 85, of FIG. 7; and the second fluid valve is controlled by the controller, 109, via control connection, e, of FIG. 7.

D. Use of Two or More Separate Fuels

Penetration of a slurry spray, when injected into a diesel engine combustion chamber, is limited by cylinder diameter, and the length of the time delay period between fuel injection and the occurrence of compression ignition. Residual petroleum fuels have much longer compression ignition time delay periods than does No. 2 diesel fuel. Thus, if residual petroleum fuels are used alone in small or medium bore diesel engines, excess fuel penetration to the cylinder wall may occur. Such excess penetration can be avoided by use of a composite slurry comprising, a principal portion of first fluid residual fuel particles, suspended in the continuous water phase, plus a separate portion of secondary first fluid igniter fuel particles, also suspended in the same continuous water phase. The igniter fuel could be selected from a variety of fuels having short ignition delay properties, such as high cetane number distillate petroleum fuels, with or without cetane improver additives. A dual fuel slurrifier could be used, with one set of paired spinning discs and rotating impact cavities supplied with residual petroleum fuel as primary first fuel and another set of paired spinning discs and impact cavities supplied with igniter fuel as secondary first fuel. When cold starting the engine, the high cetane igniter fuel could be used alone.

The FIG. 7 form of this invention can be thusly operated to create a slurry product comprising a suspension of primary first fluid residual fuel particles, plus a suspension of secondary first fluid igniter fuel particles, in a single continuous water phase, by substituting the dual first fuel supply system, shown schematically in FIG. 10, for the single first fluid supply system of FIG. 9. Two separate first fluid supply systems, a residual fuel supply system, 115, and an igniter fuel supply system, 116, are used, each of which is essentially similar to the FIG. 9 form of fuel supply system, as described hereinabove. Residual fuel from connections, 117, and 118, of FIG. 10, is delivered into connections, 75, and 77, of FIG. 7, to be delivered respectively on to the top surfaces of the lower paired spinning discs, 70, and 71. Igniter fuel from connections, 119 and 120 of FIG. 10, is delivered into connections 79 and 81 of FIG. 7, to be delivered respectively onto the top surfaces of the upper paired spinning discs, 72 and 73. A single water supply system delivers water into the entry plate, 83, of FIG. 7, as described hereinabove. The relative proportions of residual fuel and igniter fuel, in the final dual fuel slurry, can be adjusted in various ways, as for example by adjusting the fuel delivery pressure in the separate fuel reservoirs, 121 and 122, via the separate back pressure valves, 123 and 124. Alternatively the relative proportions of residual fuel and igniter fuel can be adjusted by adjusting the duration and frequency of fuel pulses, controlled by the controller, 125, acting to open and close the valves, 126, 127, 128 and 129.

E. Industrial Uses of This Invention

One of the principal beneficial objects of this invention is to develop a method for cleanly and efficiently burning high viscosity, low cost, residual petroleum fuels and tars in small bore, high speed, diesel engines, which are a principal power source for our national transportation system, and which now require use of low viscosity, high cost, distillate petroleum fuels. In a diesel engine, the liquid fuel must be broken up into many small particles, in order to provide a large area between fuel and air, for rapid and efficient fuel burnup. High viscosity fuels resist this breaking up process during fuel injection, and thus higher fuel injection pressures, for stronger resulting fuel atomization forces, are required. But higher fuel injection pressures create greater fuel injection penetration into the engine cylinder, and this penetration is necessarily limited by the engine cylinder bore. In this way, small bore diesel engines need to use moderate fuel injection pressure, with consequently moderate atomizing forces, and thus now require use of low viscosity, high cost, distillate petroleum fuels.

In a rotary slurrifier of this invention, very strong atomizing forces can be applied to a high viscosity fuel by the high density of the water, into which the fuel is thrown at high relative velocity. A much finer fuel atomization can be obtained, in large part because the water density is much greater than the compressed air density inside a diesel engine cylinder, during fuel injection. Preatomization of a residual fuel, in a rotary slurrifier of this invention, makes possible efficient use of these high viscosity fuels in small bore diesel engines, since the engine fuel injection system is relieved of the requirement of accomplishing the entire atomization process.

The burning of preatomized fuel in water slurry can be further improved by dissolving gases, such as carbon dioxide, into the water portion of the slurry, at high gas pressure. When such gas laden slurry fuels are injected into the lower pressure in a diesel engine cylinder, these dissolved gases expand out of solution, to separate the fuel particles further. Apparatus for thusly further improving the atomization of slurry fuels is described in the applications listed under "Cross References to Related Applications." This material is incorporated herein by reference thereto.

Some tar fuels are solid at room temperatures, and preheating of the tar, as well as the water and the slurrifier, will be needed if tar in water slurries are to be created in slurrifiers of this invention.

A diesel engine, running on a fuel in water slurry, suffers a loss of efficiency, due to the energy lost to the evaporation of the water portion of the slurry. For this reason high slurry ratios of fuel to water are preferred. Some evidence suggests that slurries of liquid fuel in water may transform into emulsions at slurry mass ratios of fuel divided by water much in excess of about one.

This appears to be a tentative upper limit of usable fuel in water slurry mass ratio for diesel engine use. For any particular slurry mass ratio, a rotary slurrifier of this invention, comprising two or more pairs of flow connected impact cavities, with aligned spinning discs, will yield a larger number of smaller fuel particles, as preferred, than a similar slurrifier, comprising only one pair of impact cavities and spinning discs, since the impact slowdown of the water in each cavity is reduced as the impacting fuel quantity per cavity is reduced. This advantage of multiple pairs of impact cavities is partially offset by the increased cost and complexity of the rotary slurrifier.

Alternatively, these benefits, from use of two or more impact cavity pairs with aligned spinning discs, can also be fully realized by use of a rotary slurrifier with but one pair of impact cavities, by creating the final slurry product in steps of recycling a first batch, back through the slurrifier, as the second fluid. This recycling of slurry can be beneficially repeated several times to create the final slurry product.

Rotary slurrifiers of this invention can also be used to assist in the preparation of triple slurries. One example triple slurry would comprise pulverized coal particles, suspended as a first slurry in a residual petroleum fuel, with small particles of this first slurry suspended, in turn, in a continuous water phase, in a rotary slurrifier of this invention, to create a final triple slurry product. Double slurries of coal particles in water caused severe wear of diesel engine fuel injector nozzles, which may have resulted from solid coal particle impacts upon the nozzle interior surfaces. But in a triple slurry these coal particles are encased in high viscosity residual fuel which may adequately cushion the particle impacts and eliminate, or reduce, this fuel injector nozzle wear.

Another example triple slurry could comprise finely shredded cellulose, from farm cellulose material, suspended as a first slurry in a residual or other petroleum fuel, with small particles of this first slurry suspended, in turn, in a continuous water phase, in a rotary slurrifier of this invention, to create a final triple slurry product. The petroleum fuel could function to keep the cellulose dry, and also to initiate combustion and burnup of the cellulose fuel. This farm cellulose based triple slurry would not cause diesel engine wear, of either the fuel injector nozzles, or the cylinder liners and piston rings, being a relatively soft material, with very low ash content.

Renewable farm cellulose material, created by solar photosynthesis, can be more efficiently utilized, as an energy source, in this triple slurry form, than is possible by processing only a small portion of farm cellulose, into ethanol or biodiesel fuels, since all, or a major portion, of the cellulose can be utilized as an energy source. Preferably the usual farm cellulose product could be divided into three portions; a food portion for human consumption and livestock feed; a portion to be plowed back into the soil to maintain fertility of the soil; and an energy supply portion to be put into a triple slurry as an energy source for our national transportation needs.

F. Slurrifier Sizing

An example use for the slurrifiers of this invention is to create slurries of first fluid residual petroleum fuel particles, in a continuous second fluid water phase, with the fuel particle mean diameter approximately equal to mean particle diameters as used currently in small and medium bore diesel engines, using number 2 distillate diesel fuel. By thusly preatomizing the residual fuel, outside the engine, adequately rapid and complete residual fuel burnup can be achieved, when the slurry is injected into an engine combustion chamber. The present status of atomization theory does not appear adequately firm to permit an analytical procedure for sealing the atomization of number 2 distillate diesel fuel, inside an engine, up to the atomization of a residual fuel into water, inside a slurrifier of this invention. The following interactive Reynolds number (IRe), indicating a ratio of aerodynamic atomizing forces, created by the atomizing medium, to viscous flow resistance forces of the fuel in the fuel jet, can perhaps be used for this preliminary estimate of slurrifier operating conditions needed to match diesel engine atomization:

$$(IRe) = \frac{(dA)(Relvel)(SMD)}{(VisF)}$$

Wherein:

(dA)=Density of the atomizing medium; compressed air at about 15 to 1 compression ratio in a diesel engine (dA)=1.11 lbsm per cubic foot; or water in a slurrifier (dA)=62.4 lbsm per cubic foot;

(Relvel)=Relative velocity between fuel and atomizing medium at initial impact, feet per second;

(SMD)=Sauter Mean Diameter of the atomized fuel particles as an index of surface to volume ratio, feet;

(VisF)=Fuel viscosity, lbsm per foot second;

The impact velocity of fuel relative to compressed air in the diesel engine combustion chamber can be estimated with usual nozzle flow relations. The velocity of fuel relative to water, in the slurrifier impact cavities can be estimated with the following approximate relation:

$$(\text{Relvelslur})=(RD)(AV)\sqrt{(TVR)^2+(RVR)^2}+(Ria)(AV)$$

Wherein:

(RD)=Spinning disc outer radius, ft.

(AV)=Spinning disc and cavity shell angular velocity, assumed equal, radians per second (Ria)=Average radius of the inner cavity fluid ring about the centerline of rotation, ft, (a)(Ria)=(RD);

(TVR)=Ratio of fuel tangential velocity at spinning disc exit to disc edge velocity (RD)(AV);

(RVR)=Ratio of fuel radial velocity at spinning disc exit to disc edge velocity;

(Disc RPM)=(9.55) (AV);

Use of radial guide vanes, symmetrically placed on the top surfaces of the spinning discs, assures fuel tangential velocities, at disc exit, will essentially equal disc edge velocity (TVR 1.0). Fuel radial velocity at disc exit will increase with fuel flow rate across the disc surface.

Thusly estimated spinning disc and rotating cavity shell RPM values, needed for slurrifier atomization of No. 5 Fuel oil, equivalent to diesel engine atomization of No. 2 diesel fuel, are shown graphically on FIG. 11, for several values of spinning disc radius, (RD), for discs with radial guide vanes. Fuel injection pressures used in small and medium bore diesel engines vary over the range of values shown, both during the injection process of a particular engine, and between different engine designs. The relation shown on FIG. 11 relates equality of atomization to equality of interactive Reynolds number.

The power required to drive a slurrifier can be estimated from the following approximate relations, based primarily on momentum balances, on the fuel to water impact within the impact cavities.

$$(PSD)=(QF)(dF)(a^2)(KED)(TVR)^2+(RVR)^2$$

Wherein:

(PSD)=Power required to rotate all spinning discs assuming equal fuel flow to each disc, foot lbsf per sec.;

(QF)=Total fuel flow rate, cubic feet per sec., to all discs;

(dF)=Fuel density, lbsm per cubic foot;

$$(KED) = \frac{(RD)^2(AV)^2}{2g(a)^2}$$

(g)=Gravity constant, 32.2 feet per (sec)$^2$;

Where radial guide vanes are used on the spinning discs the values of (TVR) and (RVR) can be approximated as 1.0 and 0.5, respectively;

(PSCD)=Power required to rotate cavity shell, foot lbsf per sec.;

(PSCD)=(Factor I)+(Factor II)+(Factor III)

Wherein:

$$(\text{Factor I}) = (Qw)(dw)(KED)\left[(2n+1) - \sum_{m=1}^{m=2n}(AVRM)^2\right]$$

(Factor I)=Power required to restore water angular momentum after impact loss;

$$(\text{Factor II}) = \frac{(QF)(dF)(KED)}{(2n)}\left[\sum_{m=1}^{m=2n}(m) - \sum_{m=1}^{m=2n}(m)(AVRM)^2\right]$$

(Factor II)=Power required to restore already slurrified fuel angular momentum after subsequent impact loss;

$$(\text{Factor III}) = 2(c)(KED)\left[(2n) - \sum_{m=1}^{m=2n}(AVRM)^2\right]$$

(Factor III)=Power required to overcome viscous shear forces in the inner fluid ring of the several impact cavities;

Wherein:

(Qw)=Water flow rate, cubic feet per sec.;

(dw)=Water density, lbsm per cubic foot;

(n)=Number of impact cavity pairs in the cavity shell; the number of impact cavities and spinning discs being (2n);

(m)=Integral numeral assigned, in sequence, to each impact cavity, starting with one for the bottom impact cavity, in the direction of water flow through the cavity shell;

(AVRM)=Ratio of fluid angular velocity in the inner ring of an impact cavity, to cavity shell angular velocity; with different values for each impact cavity;

Inner cavity fluid ring angular velocity is reduced, below cavity shell angular velocity, by fuel impact, and is restored to cavity shell angular velocity when fluid passes over the radial guide vanes in the outer cavity ring.

$$(AVRM) = \left[\frac{A + (m-1)B + C - B(a)^2}{A + (m-1)B + C + B}\right]$$

Wherein:

(A) =(Qw)(dw)

$$(B) = \frac{(QF)(dF)}{(2n)}$$

$$(C) = (VISW)\frac{2\pi(e)(RD)}{(a)(Kh)}\left[\left(\frac{1}{e}\right) + \left(\frac{2}{y}\right)\right]$$

(VISW)=Fluid viscosity in inner cavity ring, lbsm per foot sec.

(e) =Ratio of spinning disc outer radius (RD), to impact cavity height, (h), between plates enclosing the cavity, $$(e) = \frac{RD}{h}$$

(h)=Impact cavity height, ft.;

(y)=Ratio of spinning disc outer radius to inner cavity fluid ring radial depth;

(Kh)=Twice the ratio of thickness of inner cavity fluid ring shear layer to cavity height (h); 0<Kh<1.0;

The power recovered in the slowdown turbine can be estimated from the following approximate relation:

$$(TUR) = \left(\frac{RN}{RD}\right)^2(a)^2(KED)(NF)[(QF)(dF) + (Qw)(dw)]$$

(TUR)=Slowdown turbine power output, foot lbsf per sec;

(RN)=Turbine reaction nozzle radius, ft.;

(NF)=Turbine nozzle factor;

(NF)=$[\sqrt{I-(J)^2}-(I-(J)^2)]$ (j)=Ratio of slowdown turbine cavity entry plate inner radius (Rix), to turbine nozzle radius;

The total power required to run the slurrifier can be estimated as the sum of the spinning disc power (PSD), plus the cavity shell power (PSCD), less the slowdown turbine power (TUR).

The ratio of total power required to operate the slurrifier, to the lower heating value of the fuel being slurrified, is an index of fuel efficiency lost to slurrification, and can be estimated with the following relation:

(SPR)=Slurrifier power to fuel energy rate ratio:

$$[SPR] = \frac{[(PSD) + (PSCD) - (TUR)}{(QF)(dF)(LHV)(778)}$$

Wherein:

(LHV)=Fuel lower heating value in Btu per lbsm;

The rotating cavity shell will be subject to centrifugal stresses, due to the shell mass, plus pressure vessel stresses, due to centrifugal pressure of the rotating fluid within the impact cavities. These stresses can be estimated from the following approximate relation:

(ss)=Shell stress, lbsf per square foot;

$$(ss) = (2)(KED)\left(\frac{a}{f}\right)^2\left[(ds) + (dw)\left(\frac{1-\left(\frac{f}{a}\right)^2}{(2)(ts)}\right)\right]$$

Wherein:

(f)=Ratio of spinning disc radius (RD) to shell outer radius (RS);

(ds)=Density of cavity shell material, lbsm per cubic foot;

(ts)=Cavity shell outer wall thickness, ft.;

The results of an example slurrifier sizing calculation, for a 1000 rated brake horsepower diesel engine, to be operated on slurrified No. 5 Fuel Oil, are as follows:

(a) Diesel engine brake specific fuel consumption=0.45 lbsm fuel per BHP-HR;

(b) Diesel engine fuel injection pressure on No. 2 Diesel Fuel=10,000 psia;

(c) No. 5 Fuel Oil LHV=19,000 Btu per lbsm; density (dF) =57.2 lbsm per cubic foot; viscosity (VISF)=$40\times10^3$ lbsm per ft. sec;

(d) Selected slurrifier dimensions:

(RD)=2 inches (0.1667 ft.);

(a)=0.843;

(RN)=4 inches (0.33 ft.);

One pair of spinning discs and impact cavities, (n)=1;

(RS)=3 inches (0.25 ft.);

Steel cavity shell, (ds)=487 lbsm per cu.ft.;

(NF)=Nozzle Factor=0.1337

$$\text{Ratio, } \frac{(QF)(dF)}{(Qw)(dw)} = 1.0$$

(e) Slurrifier Operating Conditions:

Shell and Disc RPM=6125

(QF) (dF)=(Qw) (dw)=0.125 lbsm per sec.

$$(PSD) = \text{Disc drive power} = 27.7\ \frac{\text{ft lbs}f}{\text{sec}}$$

$$(PSCD) = .23\ HP$$

$$(PCSD) = \text{Shell drive power} = 124.7\ \frac{\text{ft lbs}f}{\text{Sec}}$$

$$(PSCD) - .23\ HP$$

$$(TUR) = \text{Slowdown turbine power} = 24.4\ \frac{\text{ft lbs}f}{\text{sec}}$$

$$(TUR) = .04\ HP$$

(SPR)=0.000082

For a steel cavity shell thickness of 0.25 inches, the shell stress will be approximately 5800 lbsf per sq. inch;

(f) Final selection of slurrifier operating conditions is preferably determined experimentally.

At engine power output less than rated power, the fuel flow rate to the spinning discs, and the water flow rate to the cavity shell, could be reduced to a slower steady flow rate. Alternatively, fuel and water flow to the slurrifier could be pulsed, with pulse duration, or pulse frequency, adjusted to meet engine fuel requirements.

Slurrifiers could be used on board a diesel engine, as illustrated with this example sizing calculation or could be used as a production slurrifier, serving several separate diesel engines, such as for a railroad refueling facility. Surface active slurry stabilizing agents can be added into the water source, and can be useful particularly where slurries remain in storage prior to use, as with production slurrifiers.

Having thus described my invention, what I claim is:

1. A rotary slurrifier apparatus for creating a slurry of small particles of at least one first fluid, suspended in a continuous phase of an essentially mutually insoluble second fluid, and comprising:

at least one source of first fluid, and a separate source of second fluid, all of said first fluids being largely mutually insoluble in said second fluid;

a spinning disc shell comprising at least one pair of cylindrical spinning discs for each said first fluid, each pair of spinning discs comprising a lower spinning disc, and an upper spinning disc;

disc drive means for rotating the spinning disc shell, and all pairs of spinning discs, at high angular velocity, about a vertical spinning disc centerline of rotation and symmetry;

a rotating cavity shell, comprising a number of pairs of enclosed cylindrical impact cavities, equal to the number of pairs of spinning discs, each pair of impact cavities being flow connected together at their outer radius;

cavity shell drive means for rotating the cavity shell at a high angular velocity about a vertical cavity shell centerline of rotation and symmetry;

wherein each pair of flow connected impact cavities comprises a cylindrical entry plate, enclosing the bottom of the lower impact cavity; and a cylindrical exit plate, enclosing the top of the upper impact cavity; and a cylindrical separator block, separating the upper and lower impact cavities, and comprising flow passages, at the outer radius, connecting the lower impact cavity to the upper impact cavity of the pair;

wherein, for each pair of flow connected impact cavities, the inner radius of the cylindrical exit plate is greater than the inner radius of the cylindrical entry plate, and the inner radius of the cylindrical separator block is less than the inner radius of the cylindrical entry plate;

wherein the inner radius, of the cylindrical entry plate, of each pair of flow connected impact cavities, above a similar pair of impact cavities, is no less than the inner radius of the cylindrical exit plate of the flow connected pair of impact cavities next below;

wherein said rotating cavity shell further comprises a slowdown reaction turbine enclosed cavity, above the uppermost flow connected pair of impact cavities, and comprising a cylindrical entry plate, whose inner radius is no less than the inner radius of the cylindrical exit plate of that uppermost flow connected pair of impact cavities; and comprising symmetrical reaction turbine guide vanes, at a radius greater than the inner radius of the cylindrical entry plate of the reaction turbine cavity; the flow direction of the reaction turbine guide vanes is principally opposite to the direction of rotary motion of the cavity shell; the reaction turbine cavity further comprising an upper enclosing cylindrical plate whose inner radius is less than the inner radius of the cylindrical entry plate of the lowermost flow connected pair of impact cavities;

a stationary fluid collector pan positioned to collect fluid flowing through said reaction turbine guide vanes;

a stationary bracket means for supporting, the spinning disc shell and disc drive means, and also the rotating cavity shell and cavity shell drive means, so that the spinning disc centerline of rotation is coincident with the cavity shell centerline of rotation;

wherein the direction of rotation of the spinning disc shell is opposite to the direction of rotation of the cavity shell;

a number of separate first fluid delivery means for delivering first fluid portions on to top surfaces of said pairs of spinning discs, equal to the number of separate first fluids, each said separate fluid delivery means delivering first fluid portions from but one separate source of first fluid, and on to the top surfaces of pairs of spinning discs;

wherein said stationary support bracket means further aligns each pair of flow connected impact cavities with one pair of spinning discs receiving first fluid portions from but one source of first fluid, and further aligns each pair of flow connected impact cavities so that first fluid portions spun off the top surfaces of the aligned pair of spinning discs will enter the flow connected pair of impact cavities;

wherein each two common first fluid portions, delivered onto the two top surfaces, of each pair of spinning discs aligned with a pair of flow connected impact cavities, are essentially equal fluid portions, and are delivered essentially concurrently onto the two top surfaces; whereby centrifugal force, created by disc rotation, will cause those common first fluid portions, delivered onto the top surface of each pair of spinning discs, to be thrown off the outer radius of each spinning disc, and into the aligned flow connected impact cavities;

wherein the outer radii, of the upper and lower spinning discs of each pair, are equal and are less than the inner radius of the cylindrical entry plate, of that flow connected pair of impact cavities, with which that pair of spinning discs is aligned;

second fluid delivery means for delivering second fluid portions, from said source of second fluid, on to the top surface of the cylindrical entry plate of the bottommost flow connected impact cavity pair; whereby centrifugal force, created by cavity shell rotation, will cause those second fluid portions, delivered on to the top surface of the cylindrical entry plate of the bottommost flow connected impact cavity pair, to form into a pair of cylindrical second fluid masses, occupying all or a portion of the bottom pair of flow connected impact cavities;

and further whereby continued delivery of second fluid portions, on to the top surface of the cylindrical entry plate, of the bottommost flow connected impact cavity pair, will cause delivery of portions of second fluid upward, past the inner radius of the cylindrical exit plate of the bottommost impact cavity pair, and past the inner radius and on to the top surface of the cylindrical entry plate of the next above flow connected impact cavity pair, whereby the next above pair of impact cavities also becomes occupied, in whole or part, by a pair of rotating cylindrical masses of second fluid;

and additionally whereby continued delivery of portions of second fluid, on to the top surface of the cylindrical entry plate of the bottommost flow connected impact cavity pair, will cause a continued delivery of second fluid portions upward, into and through each successive pair of flow connected impact cavity pair above, so that all impact cavity pairs become occupied by rotating cylindrical masses of second fluid; and this continued upward delivery of second fluid continues into the slowdown reaction turbine cavity, and out of the reaction turbine cavity, via the reaction turbine flow directors and into the stationary collector pan;

finally whereby first fluid portions are thrown into the counter rotating cylindrical masses of second fluid, in the impact cavities, and the high relative velocity of impact between first fluid and second fluid atomizes the first fluid into many small particles, suspended in a continuous phase of the mutually insoluble second fluid, and this resulting slurry is slowed down and discharged into a stationary collector pan.

2. A rotary slurrifier apparatus for creating a slurry of small particles of at least one first fluid, suspended in a continuous phase of an essentially mutually insoluble second fluid, as described in claim 1, and further comprising radial guide vanes symmetrically positioned within each pair of flow connected impact cavities;

wherein the inner radius of said radial guide vanes is greater than the inner radius of the cylindrical exit plate of the flow connected pair of impact cavities containing the radial guide vanes.

3. A rotary slurrifier apparatus for creating a slurry of small particles of at least one first fluid, suspended in a continuous phase of an essentially mutually insoluble second fluid, as described in claim 2:

wherein portions of first fluid are delivered as a continuous flow on to the top surfaces of each spinning disc;

and further wherein portions of second fluid are delivered as a continuous flow on to the top surface of the cylindrical entry plate of the bottommost impact cavity pair.

4. A rotary slurrifier apparatus for creating a slurry of small particles of at least one first fluid, suspended in a continuous phase of an essentially mutually insoluble second fluid, as described in claim 3, and further comprising:

first fluid flow rate adjustment means for adjusting the continuous rate of flow of first fluid on to the top surfaces of each spinning disc;

second fluid flow rate adjustment means for adjusting the continuous rate of flow of second fluid on to the top surface of the cylindrical entry plate of the bottommost impact cavity pair.

5. A rotary slurrifier apparatus for creating a slurry of small particles of at least one first fluid, suspended in a continuous phase of an essentially mutually insoluble second fluid, as described in claim 2:

wherein portions of first fluid are delivered intermittently, as a group of single pulses, each such group of pulses consisting of at least one pulse, on to the top surfaces of each spinning disc;

wherein portions of second fluid are delivered intermittently, as single pulses, on to the top surface of the cylindrical entry plate of the bottommost impact cavity pair;

wherein said group of pulses of first fluid are delivered concurrently on to the top surfaces of both spinning discs aligned to a flow connected pair of impact cavities;

and further wherein each delivery of a pulse of second fluid, is followed by a delivery of a group of pulses of first fluid, and each delivery of a group of pulses of first fluid is followed, after a pulse time interval, by a delivery of a pulse of second fluid.

6. A rotary slurrifier apparatus for creating a slurry of small particles of at least one first fluid, suspended in a continuous phase of an essentially mutually insoluble second fluid, as described in claim 5, and further comprising:

pulse time interval adjustment means for adjusting the duration of said pulse time interval.

7. A rotary slurrifier apparatus for creating a slurry of small particles of at least one first fluid, suspended in a continuous phase of an essentially mutually insoluble second fluid, as described in claim 5, and further comprising:

second fluid pulse quantity adjustment means for adjusting the quantity of second fluid delivered in each pulse of second fluid;

first fluid pulse quantity adjustment means for adjusting the quantity of first fluid delivered in each pulse of first fluid.

8. A rotary slurrifier apparatus for creating a slurry of small particles of at least one first fluid, suspended in a continuous phase of am essentially mutually insoluble second fluid, as described in claim 5, and further comprising;

first fluid pulse number adjustment means for adjusting the number of single pulses of first fluid in each group of single pulses of first fluid;

second fluid pulse quantity adjustment means for adjusting the quantity of second fluid delivered in each pulse of second fluid.

9. A rotary slurrifier apparatus for creating a slurry of small particles of at least one first fluid, suspended in a continuous phase of an essentially mutually insoluble second fluid, as described in claim 2;

wherein each spinning disc comprises radial guide vanes symmetrically secured to the top surface of each spinning disc.

10. A rotary slurrifier apparatus for creating a slurry of small particles of at least one first fluid, suspended in a continuous phase of an essentially mutually insoluble second fluid, as described in claim 9:

wherein each spinning disc comprises a cylindrical cup enclosure secured symmetrically to the bottom surface of the spinning disc, and whose inner radius is greater than the inner radius of the spinning disc to which secured, and comprising a cylindrical cup bottom entry plate;

wherein said first fluid delivery means for delivering first fluid portions onto the top surfaces of pairs of spinning discs, delivers said first fluid portions onto the top surfaces of said cup bottom entry plate;

whereby centrifugal force due to cup and disc rotation transfers said first fluid portions more uniformly to the top surface of each said spinning disc.

11. A rotary slurrifier apparatus for creating a slurry of small particles of at lease one first fluid, suspended in an essentially continuous phase of a mutually insoluble second fluid, as described in claim 9:

wherein portions of first fluid are delivered as a continuous flow onto the top surfaces of each spinning disc;

and further wherein portions of second fluid are delivered as a continuous flow onto the top surface of the cylindrical entry plate of the bottommost impact cavity pair;

and further comprising:

first fluid flow rate adjustment means for adjusting the continuous rate of flow of first fluid onto the top surfaces of each spinning disc;

second fluid flow rate adjustment means for adjusting the continuous rate of flow of second fluid onto the top surface of the cylindrical entry plate of the bottommost impact cavity pair.

12. A rotary slurrifier apparatus for creating a slurry of small particles of at least one first fluid, suspended in a continuous phase of an essentially mutually insoluble second fluid, as described in claim 9:

wherein portions of first fluid are delivered intermittently, as a group of single pulses, each such group of pulses consisting of at least one pulse onto the top surfaces of each spinning disc;

wherein portions of second fluid are delivered intermittently, as single pulses, onto the top surface of the cylindrical entry plate of the bottommost impact cavity pair;

wherein said group of pulses of first fluid are delivered concurrently onto the top surfaces of both spinning discs aligned to a flow connected pair of impact cavities;

and further wherein each delivery of a pulse of second fluid, is followed by a delivery of a group of pulses of first fluid, and each delivery of a group of pulses of first fluid is followed, after a pulse time interval, by a delivery of a pulse of second fluid.

13. A rotary slurrifier apparatus for creating a slurry of small particles of at least one first fluid, suspended in a continuous phase of an essentially mutually insoluble second fluid, as described in claim 12: and further comprising:

pulse time interval adjustment means for adjusting the duration of said pulse time interval.

14. A rotary slurrifier apparatus for creating a slurry of small particles of at least one first fluid, suspended in a continuous phase of an essentially mutually insoluble second fluid, as described in claim 12:

and further comprising:

second fluid pulse quantity adjustment means for adjusting the quantity of second fluid delivered in each pulse of second fluid;

first fluid pulse quantity adjustment means for adjusting the quantity of first fluid delivered in each pulse of first fluid.

15. A rotary slurrifier apparatus for creating a slurry of small particles of at least one first fluid, suspended in a continuous phase of an essentially mutually insoluble second fluid, as described in claim 12: and further comprising;

first fluid pulse number adjustment means for adjusting the number of single pulses of first fluid in each group of single pulses of first fluid;

second fluid pulse quantity adjustment means for adjusting the quantity of second fluid delivered in each pulse of second fluid.

* * * * *